United States Patent [19]

Gustavsson et al.

[11] Patent Number: 5,007,986

[45] Date of Patent: Apr. 16, 1991

[54] CREPING DOCTOR WITH TWO SUCTION CHAMBERS IN THE SUPPORT BEAM

[75] Inventors: Tord G. Gustavsson, Forshaga; Frans O. S. Lyxell; Karl T. I. Silja, both of Karlstad, all of Sweden

[73] Assignee: Valmet Paper Machinery, Inc., Helsinki, Finland

[21] Appl. No.: 486,155

[22] Filed: Feb. 28, 1990

[30] Foreign Application Priority Data

Mar. 15, 1989 [SE] Sweden ..... 8900912

[51] Int. Cl.[5] ..... D21G 3/04

[52] U.S. Cl. ..... 162/281; 162/272; 162/363; 15/256.51; 34/120

[58] Field of Search ..... 162/281, 280, 272, 363; 34/120, 117, 85; 15/256.5, 256.51, 306 A

[56] References Cited

U.S. PATENT DOCUMENTS

| | | | |
|---|---|---|---|
| 3,003,176 | 10/1961 | Goyette | 15/256.51 |
| 4,019,953 | 4/1977 | Nystrom | 162/272 |
| 4,906,333 | 3/1990 | Myren | 162/272 |

FOREIGN PATENT DOCUMENTS

| | | | |
|---|---|---|---|
| 1104319 | 4/1961 | Fed. Rep. of Germany . | |
| 1268955 | 5/1968 | Fed. Rep. of Germany . | |
| 0564379 | 7/1977 | U.S.S.R. | 15/306 A |

*Primary Examiner*—Karen M. Hastings

*Attorney, Agent, or Firm*—Bell, Seltzer, Park & Gibson

[57] ABSTRACT

A creping doctor (2) for creping a soft paper web (3) off a yankee cylinder (1) is described which comprises a supporting beam (4) disposed close to the envelope surface of the yankee cylinder (1) and provided with an internal space, the internal space of the supporting beam (4) is divided into a first longitudinal suction chamber (24) and a second longitudinal suction chamber (25). The creping doctor also produces a subatmospheric pressure in the suction chambers (24, 25); a first suction connection (18, 19, 21) connecting the first suction chamber (24) of the supporting beam (4) to an external dust-generating space (7) located between the doctor blade (6) and the soft paper web (3) creped off; and a second suction connection (40, 42, 43) connecting the second suction chamber (25) of the supporting beam (4) with an internal dust-generating space (8) located between the doctor blade (6) and the envelope surface of the yankee cylinder (1).

9 Claims, 3 Drawing Sheets

CREPING DOCTOR WITH TWO SUCTION CHAMBERS IN THE SUPPORT BEAM

FIELD AND BACKGROUND OF THE INVENTION

The present invention relates to a creping doctor for creping a soft paper web off a yankee cylinder.

U.S. Pat. No. 4.019.953 (corresponding to SE-B-381899) describes an apparatus for removing dust released in the form of fibers and other particles from a paper web when this is creped off a yankee cylinder, said apparatus comprising a pick-up receptacle disposed below the dust-generating region and at the side of a supporting beam. A duct for the supply of compressed air is connected to the receptacle as well as a suction pipe to remove the dust laden air entrained by jets of compressed air supplied at various points across the direction of movement of the web. Such an apparatus is clumsy, requires considerable space and is relatively ineffective. It does not take care of the dust released on the side of the doctor blade facing the envelope surface of the yankee cylinder. Moreover, there is a space between the pick-up receptacle and supporting beam of the creping doctor, through which dust can pass without being drawn into the pick-up receptacle. Since the apparatus requires a large space the replacement of the doctor blade is made difficult.

DE-A-1 104 319 describes a doctor especially for drying cylinders in paper machines. This doctor is provided with a doctor blade for cleaning the envelope surface of the drying cylinder by abutting with a low pressure against the envelope surface so that pulp fibers, fillers and the like are scraped off the surface. The doctor has a doctor holder mounted on a bracket on a pipe, a pressure plate abutting against the doctor blade and being provided with a plurality of suction openings communicating with the internal space of the pipe via a channel through the doctor holder and bracket. This known doctor cannot be used as a creping doctor, partly because it is not designed to withstand the considerable linear pressure of about 360–500 kg/m which must be exerted by a doctor blade on the envelope surface of a yankee cylinder, neither is the suction connection from said suction openings to the interior of the pipe arranged or adapted for the relatively large quantities of dust released when creping a paper web off a yankee cylinder. A similar doctor is described in DE-A-1 268 955, this being supplemented with compressed-air channels discharging in the vicinity of the doctor blade, and special closing covers to regulate the suction air along the pipe. This known doctor is not suitable as a creping doctor for yankee cylinders either, for the same reasons as discussed for the doctor according to DE-A-1 104 319.

A problem which has not been touched in greater detail in the patent literature, and which is specific to creping a paper web off a yankee cylinder, refers to the dust produced inside the doctor blade, i.e. on the side thereof facing the envelope surface of the yankee cylinder, and with which the doctor blade forms an acute angle. Dust in and from this internal dust-generating space has been found to form bundles of fibers which collect on the creping doctor and its supporting beam and which grow to such a size that they are pulled along by the yankee cylinder and adhere to its sticky envelope surface. If no cleaning doctor is provided downstream of the creping doctor, or if it does not temporarily function, these fiber bundles will accompany the yankee cylinder for one or two turns and be covered by the paper web to which they may adhere, thus causing a deterioration in the quality. There is also a risk of breakage of the paper web. Furthermore, there is considerable risk of this dust inside the doctor blade and said fiber bundles being ignited by sparks which may be generated on external parts of the yankee cylinder which are free from adhesive, due to the fact that the doctor blade made of metal presses with high linear pressure (about 360–500 kg/m) against the envelope surface of the yankee cylinder rotating at high speed. Also when replacing doctor blades there are problems with dust present between the envelope surface and, during this work, the slightly pivotally lowered creping doctor and its pivotable supporting beam, said dust being liberated as earlier but at a doctor located slightly upstream. A further problem is the great temperature differences prevailing on both sides of the supporting beam since the side of the supporting beam facing the hot yankee cylinder acquires a higher temperature than the opposite side. These temperature differences cause corresponding differences in linear expansion so that the supporting beam and creping doctor loose the desired straightness which in turn causes the doctor blade to press with an uneven linear pressure along the yankee cylinder so that the creping off effect ceases and there is risk of breakdown due to web breakage.

SUMMARY OF THE INVENTION

The object of the present invention is to provide an improved creping doctor enabling efficient removal of the dust released on both sides of the doctor blade of the creping doctor which, compared with known creping doctors, requires considerably less space and ensures that the supporting beam will remain straight.

The present invention relates to a creping doctor for creping a soft paper web off a yankee cylinder, comprising a supporting beam disposed parallel to the yankee cylinder and close to the envelope surface thereof and provided with an internal space, said internal space being divided into a first longitudinal suction chamber and a second longitudinal suction chamber; a doctor blade; a doctor holder mounted to the supporting beam; means for producing a subatmospheric pressure in the internal space of the supporting beam; a first suction connection connecting said first suction chamber of the supporting beam to an external dust-generating space located between the doctor blade and the soft paper web creped off; and a second suction connection connecting said second suction chamber of the supporting beam with an internal dust-generating space located between the doctor blade and the envelope surface of the yankee cylinder.

The invention will be described further in the following with reference to the drawings.

DESCRIPTION OF PREFERRED EMBODIMENTS

Figure 1:
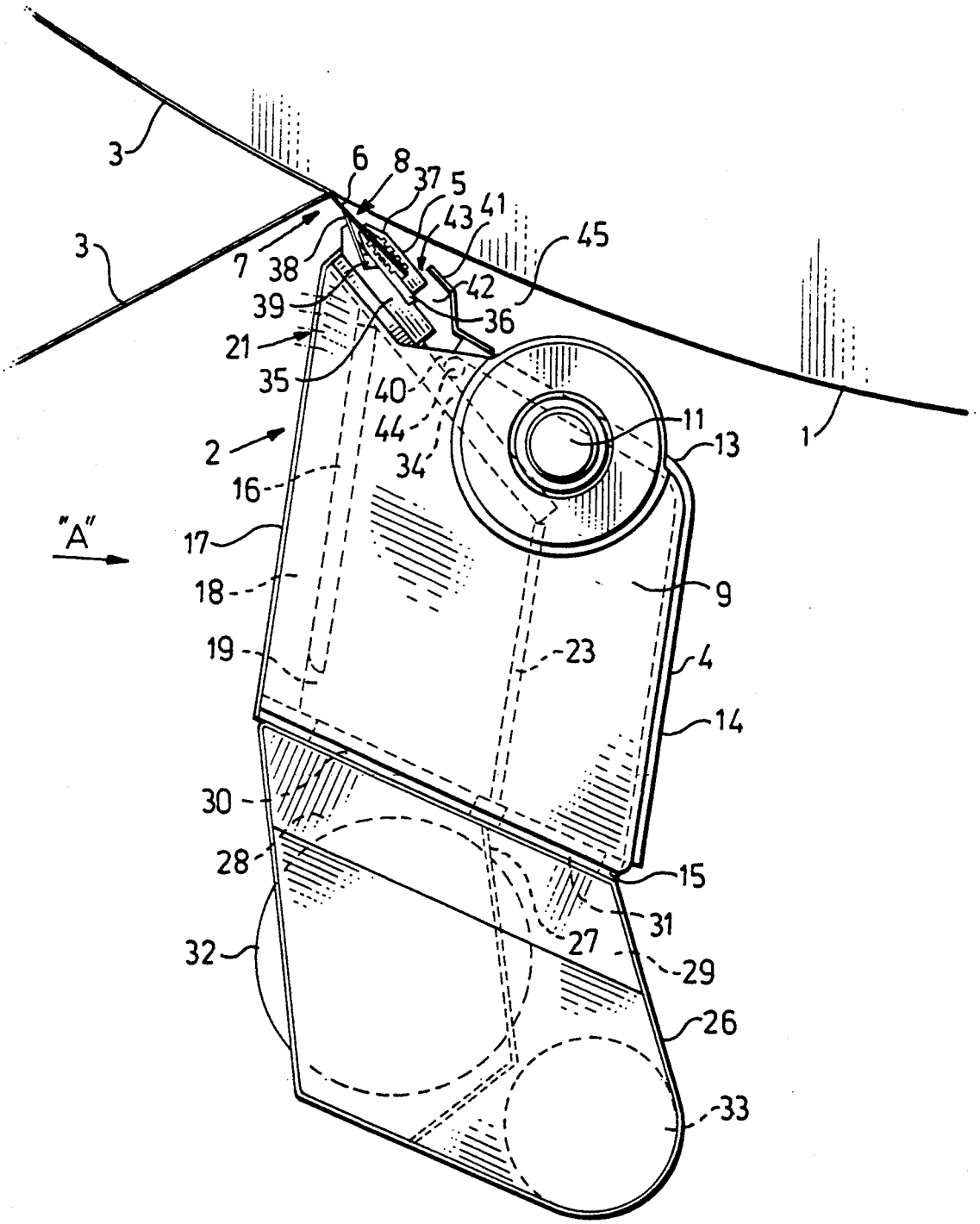
FIG. 1 is an end view of a section of a paper machine containing a yankee cylinder and a creping doctor in accordance with a first embodiment of the invention.

With reference to FIG. 1, it is shown therein a section of a paper machine comprising a yankee cylinder 1, rotating counterclockwise, and a creping doctor 2. A paper web 3, which adheres onto the envelope surface of the yankee cylinder 1, moves down to the creping doctor 2 where the paper web is creped off the yankee cylinder 1 by means of the creping doctor 2. The creping doctor 2 comprises a hollow supporting beam 4 disposed parallel and close to the yankee cylinder 1, a doctor holder 5 mounted to the supporting beam, and a doctor blade 6 mounted to the doctor holder 5. The creped paper web 3 moves obliquely downwards from the creping doctor 2 and may pass a plurality of means (not shown), such as grammage scanner and spreader, before reaching a reeler (not shown) in which the creped paper web is rolled into rolls of soft paper.

During the creping dust is released from the paper web 3 and part of this dust will be entrained in a boundery layer on each side of the creped paper web 3, which is moving at high speed. An essential amount of the dust in these boundary layers is taken care of and removed by means of special devices mounted on each side of the creped paper web 3 at suitable points between the creping doctor 2 and said grammage scanner, not shown. Substantially all the remaining dust will fall down from the spaces on both sides of the doctor blade 6 and its doctor holder 5.

The invention concerns itself with the measure to take care of at least the major part of said dust which is released from the paper web 3 upon its creping off the yankee cylinder 1 and is not entrained in said boundary layers, but falls downwards from both an outer dust-generating space 7 between the creping doctor 2 and the paper web 3 and an inner dust-generating space 8 between the creping doctor 2 and the envelope surface of the yankee cylinder 1.

Figure 2:
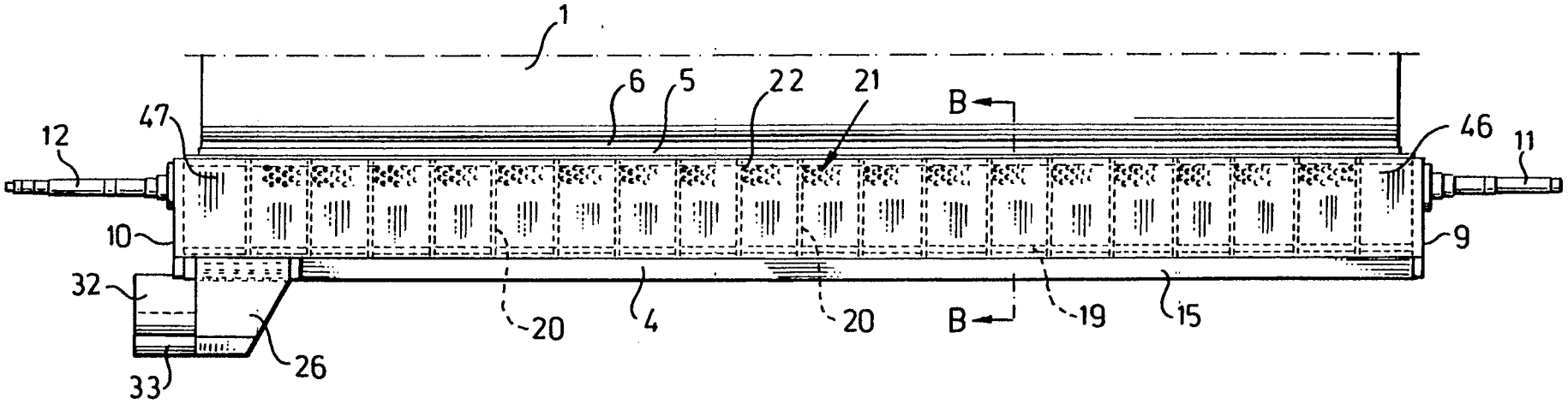
FIG. 2 is a view of the creping doctor according to FIG. 1, seen in the direction indicated by the arrow "A", the creped soft paper web having been omitted.
Figure 3:
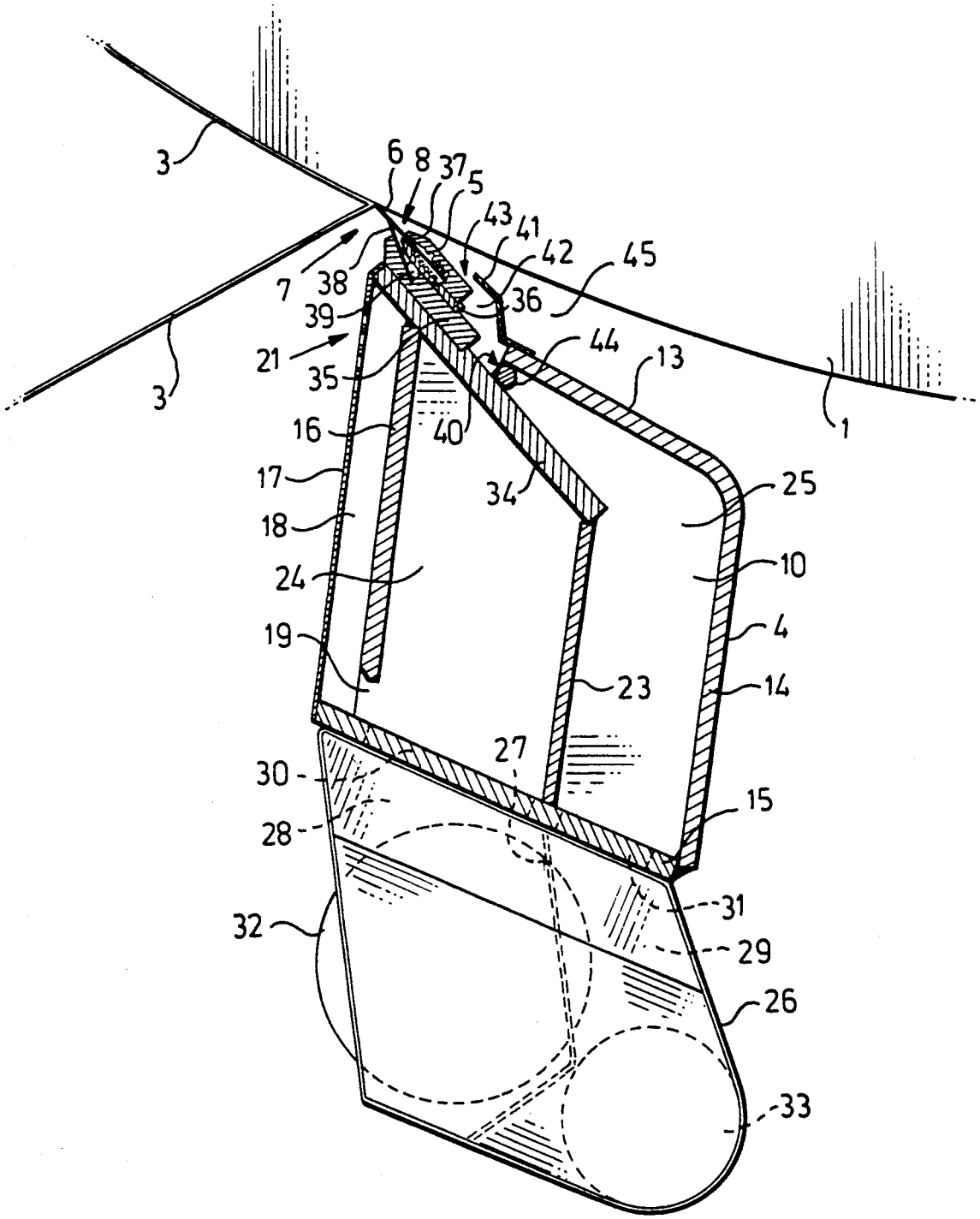
FIG. 3 is a cross section of the creping doctor according to the line B—B in FIG. 2.

As will be seen more clearly in FIG. 2, the supporting beam 4 is provided at its end walls 9, 10 with shaft pins 11, 12 which are journalled in a stand (not shown) so that the creping doctor 2 can be pivoted about the shaft pins 11, 12 from a lowered position when the doctor blade 6 is being replaced, to an upper, operating position when the doctor blade 6 is pressing with a predetermined pressure, usually a linear pressure of about 360–500 kg/m, on the envelope surface of the yankee cylinder 1.

The hollow supporting beam 4 is further connected to a suction source (not shown) for removing dust from the dust-generating spaces 7, 8 on both sides of the doctor blade 6 via first and second suction connections described in more detail below, of the supporting beam 4 and via the internal space of the supporting beam which therefore has the double function of supporting the doctor holder 5 and defining a dust suction box. Said suction connections extend between the end walls of the supporting beam or from points just inside these end walls, and they have no interruptions other than those caused by supporting members mounted therein to carry the walls of the suction connections.

The supporting beam 4 comprises a top wall 13, a rear side wall 14, a bottom wall 15 and a front side wall 16, said walls extending between the end walls 9, 10 of the supporting beam. The cross section of the support beam 4 is preferably in the form of a non-rightangled parallelogram and placed in the operating position in such a way that the top wall 13 forms a small angle, e.g. 2°–5°, with the tangent through the removal point of the paper web 3 at the edge of the doctor blade 6, and that the front side wall 16 will be very slightly inclined, e g. 5°–15°, in relation to the vertical plane. The bottom wall 15 is extended slightly past the front side wall 16 to provide support for a suction cover 17 extending a short distance, e.g. 35–45 mm, preferably 40–42 mm, outside the front side wall 16 so that a suction channel 18 is defined therebetween, the lower edge of the front side wall 16 being located a predetermined distance from the bottom wall 15 to define therebetween a suction slot 19 connecting the suction channel 18 with the internal space of the supporting beam 4. The suction cover 17 is suitably made of thin metal sheet, e.g. 2 mm in thickness, and suitable transverse support elements 20 (see FIG. 2) are mounted between the suction cover 17 and front side wall 16 to support the suction cover 17 and maintain a uniform width of the suction channel 18 so that there will be no throttlings therein. The suction cover 17 is provided with a suction opening 21, suitably located at its upper portion, i.e. as close to the outer dust-generating space 7 as possible, and extending along the supporting beam. The ends of the suction opening 21 are located at a distance from the end walls 9, 10 of the supporting beam to form unbroken end sections 46, 47 in the suction cover 17. These ensure that the edge strips obtained at an upstream trimming of the paper web will not become fixed by suction action to the supporting beam 4 but can fall freely downwards past the supporting beam to be collected. The suction opening 21 may consist of a continuous suction slot or, as in the embodiment shown in FIG. 2, of a plurality of small holes or perforations which together have a predetermined through-flow area to ensure that a desired quantity of air flows through at a given air speed. Said suction opening 21, the suction channel 18 and the suction slot 19 define said first suction connection the smallest through-flow area of which is at the inlet thereof, i.e. the suction opening 21, which ensures a uniform air through-flow along the entire length of the suction opening.

The internal space of the supporting beam 4 is divided by means of a longitudinal partition 23 into a first suction chamber 24 and a second suction chamber 25. The suction chambers communicate with said suction source via suction conduits (not shown) with valve means to regulate the air flow through the suction chambers from zero to a desired upper value and to distribute the air flow during operation to a value of about 2:1 between the first suction chamber 24 and the second suction chamber 25. The outer dust-generating space 7 is connected to the first suction chamber 24 via said first suction connection consisting of suction opening 21, suction channel 18 and suction slot 19, whereas the inner dust-generating space 8 is connected to the second suction chamber 25 via the second suction connection which will be described in more detail below. On the outer side of the bottom wall of supporting beam at one end 10 thereof is a discharge box 26 divided by a partition 27 into two cavities 28, 29 one 28 of which communicating with the first suction chamber 24 via an aperture 30 in the bottom wall 15 and the other 29 communicating with the second suction chamber 25 via an aperture 31 in the bottom wall 15. The discharge box 26 is provided with horizontal pipe connections 32, 33 for connecting said suction conduits to the suction source.

The top wall 13 of the supporting beam 4 terminates at a distance from the front side wall 16 in order to form an opening which provides place for the mounting of the doctor holder 5 and a straight, flat platform 34 extending obliquely upwards and out of the supporting beam 4 a sufficient distance so that the suction cover 17 can be attached to the outer end portion of the platform 34 and so that sufficient support surface for the doctor holder 5 is obtained. The platform 34 also forms the upper part of said partition 23 and extends obliquely downwards to a lower part of the partition 23 which is parallel to the side walls 14, 16. The doctor holder 5 has a support plate 35 for its mounting to the upper, protruding part of the platform 34 and two collet jaws 36, 37 for detachable mounting of the doctor blade 6. The collet jaws are firmly screwed to the support plate 35. A support strip 38 projects from the support plate 35 and abuts against the lower side of the doctor blade 6. A suitable elastic body 39 is disposed in an inner groove in the support plate 35, cooperating with the support strip 38 so that its abutment pressure against the doctor blade 6 will be yieldable.

The platform 34, resting on and secured to the front side wall 16, extends a predetermined distance from the top wall 13 to form a longitudinal suction slot 40 therebetween. A guide element 41 in the form of a bent plate for guiding the air flow is firmly attached to the top wall 13 and extends a suitable distance over the doctor holder 5, a predetermined distance from this and the platform 34 to form a suction channel 42 therebetween and a well defined, longitudinal suction opening 43 at the orifice of the suction channel 42 which will thus be located as close to the creping point as possible. The guide plate 41 and the envelope surface of the yankee cylinder define therebetween a free space 45 through which sufficient amount of air can be drawn in from the surroundings to the inner dust-generating space 8 to carry dust released with it into the second suction chamber 25 via said second suction connection thus formed by the suction opening 43, suction channel 42 and suction slot 40. A plurality of short, roller-shaped support elements 44 are disposed in the suction slot 40 at a suitable distance from each other to support the top wall 13 in relation to the platform 34. This ensures that the suction slot 40 will have constant width along its entire length. This is also valid to the width of the suction opening 43, since the guide plate 41 is rigidly mounted to the top wall 13. The support elements 44 are suitably welded to the platform 34 and top wall 13 and are short so that the flow of air through them will be sufficient. Suitable throttles may be disposed at the ends of the suction opening 43 to adjust the length of the suction opening. When the air drawn in from the surroundings passes through the space 45 it will be heated by the hot yankee cylinder. Air with increased temperature will thus be drawn in through the second suction connection 43, 42, 40, passing through the second suction chamber 25 the side and bottom walls of which being hot. This heating of the supporting beam 4 results in decreased difference between the temperature of the parts of the supporting beam facing the yankee cylinder and the parts facing away from the cylinder. The linear expansion will therefore be equal or substantially equal in the various parts of the supporting beam the straightness of which thus can be ensured so that the doctor blade 6 rigidly attached to the supporting beam will exert a uniform linear pressure along the whole length of the yankee cylinder. Thus, it is an essential advantage with the invention that no special heating means need usually be used to ensure the straightness of the supporting beam, or that the supporting beam only in certain cases has to be supplemented with such special heating means, particularly in the case of relatively long creping doctors as described below.

In order to obtain a desired uniform distribution of the air flows in the suction connections it may be suitable, in particular for long creping doctors, to design the suction chambers 24, 25 with increasing throughflow areas in the direction towards the discharge box 26, for instance, by disposing an inner wall in the suction chamber 24 which extends from the end wall 9 and forms a wedge-shaped, screened-off space with the partition 23 (with the tip of the wedge at or in the vicinity of the end wall 10), and a similar inner wall in the suction chamber 25 which forms a wedge-shaped, screened-off space with the side wall 14 or bottom wall 15. If necessary special heating means may be disposed in a manner known per se internally or externally of the supporting beam.

If desired openings, which are closable with covers or the like, may be disposed in one or both end walls 9, 10 to enable the suction chambers 24, 25 to be inspected and cleaned if necessary.

That which is claimed is:

1. A creping doctor for creping a soft paper web off a yankee cylinder, comprising a supporting beam adapted for mounting closely parallel to an envelope surface of a yankee cylinder, said supporting beam being provided with an internal space, said internal space being divided into a first longitudinal suction chamber and a second longitudinal suction chamber; a doctor blade; a doctor holder mounted to the supporting beam; means for producing a subatmospheric pressure in the internal space of the supporting beam; a first suction connection connecting said first suction chamber of the supporting beam to an external dust-generating space location between the doctor blade and the soft paper web to be creped off; and a second suction connection connecting said second suction chamber of the supporting beam for providing suction to an internal dust-generating space located between the doctor blade and the envelope surface of the yankee cylinder when said creping doctor is mounted closely parallel to the yankee cylinder.

2. A creping doctor as recited in claim 1 wherein a longitudinal partition separating said suction chambers comprises an upper part formed as a platform extending out of the supporting beam substantially parallel to the doctor blade for carrying the doctor holder on its side facing the envelope surface of the yankee cylinder.

3. A creping doctor as recited in claim 2 wherein a longitudinal top wall of the supporting beam is provided with an opening through which the platform extends, a longitudinal suction slot being defined between the platform and the side edge of the top wall adjacent said second suction chamber, and a guide element being disposed to protrude from the top wall to define a suction channel between itself and a part of the doctor holder to form a longitudinal suction opening facing the inner dust-generating space, said suction opening, suction channel and suction slot forming said second suction connection.

4. A creping doctor as recited in claim 1 wherein a longitudinal front side wall of the supporting beam, facing the creped soft paper web, defines a suction slot between its lower edge and a bottom wall of the supporting beam, and defines a suction channel between itself and a longitudinal suction cover disposed outside the front side wall and extending between the bottom wall and said platform and having a longitudinal suction opening facing the outer dust-generating space, said suction opening, suction channel and suction slot forming said first suction connection.

5. A creping doctor as recited in claim 4 wherein the suction opening of the suction cover is disposed in a limited section of said cover located nearest the platform.

6. A creping doctor as recited in claim 4 wherein said suction opening is formed by a plurality of evenly distributed holes is said suction cover.

7. A creping doctor as recited in claim 3 or 4 wherein each of said suction openings forms an inlet at each of said respective suction openings and each inlet has the smallest through-flow area in the suction connection.

8. A creping doctor as recited in claim 1 wherein said first suction connection, first longitudinal suction chamber, second suction connection, and second longitudinal suction chamber are dimensioned so that when said creping doctor is in use and mounted closely parallel to the envelope surface of a yankee cylinder, the air flow through the first suction connection and the first suction chamber is essentially greater than the air flow through the second suction connection and second suction chamber.

9. A creping doctor as recited in claim 8 wherein said first suction connection, first longitudinal suction chamber, second suction chamber and second longitudinal suction chamber are dimensioned so that when said creping doctor is in use and mounted closely parallel to the envelope surface of a yankee cylinder, the ratio between the air flow through the first suction connection and first suction chamber and the air flow through the second suction connection and second suction chamber is about 2:1.

* * * * *